US009091118B2

(12) United States Patent
Anderson et al.

(10) Patent No.: US 9,091,118 B2
(45) **Date of Patent: *Jul. 28, 2015**

(54) MOTORIZED ROLLER SHADE OR BLIND HAVING AN ANTENNA AND ANTENNA CABLE CONNECTION

(71) Applicant: QMOTION INCORPORATED, Pensacola, FL (US)

(72) Inventors: Craig Peter Anderson, Pensacola, FL (US); Ben L. Garcia, Cumming, GA (US); Matthew Warren Kirkland, Cantonment, FL (US)

(73) Assignee: QMOTION INCORPORATED, Pensacola, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/018,977

(22) Filed: Sep. 5, 2013

(65) Prior Publication Data

US 2014/0000818 A1 Jan. 2, 2014

Related U.S. Application Data

(63) Continuation of application No. 13/286,542, filed on Nov. 1, 2011, now Pat. No. 8,960,260.

(51) Int. Cl.

| | |
|---|---|
| ***E06B 9/72*** | (2006.01) |
| ***H01Q 1/22*** | (2006.01) |
| ***H01Q 7/00*** | (2006.01) |

(Continued)

(52) U.S. Cl.

CPC ... *E06B 9/72* (2013.01); *E06B 9/40* (2013.01); *H01Q 1/22* (2013.01); *H01Q 1/36* (2013.01); *H01Q 7/00* (2013.01); *H01Q 9/27* (2013.01); *H01Q 9/42* (2013.01); *E06B 9/50* (2013.01); *E06B 2009/6809* (2013.01)

(58) Field of Classification Search

USPC ..... 160/310, 311, 1, 7, 9, 188, 189; 343/720, 825, 830, 872, 878

IPC ..... E06B 9/70,9/72, 2009/72, 2009/725

See application file for complete search history.

(56) References Cited

U.S. PATENT DOCUMENTS

| | | | |
|---|---|---|---|
| 3,964,296 | A | 6/1976 | Matzuk |
| 4,101,899 | A | 7/1978 | Jones, Jr. et al. |

(Continued)

OTHER PUBLICATIONS

John P. Gianvitorio, et al., "Fractal Antennas: A Novel Antenna Miniaturization Technique, and Applications", IEEE Antennas and Propagation Magazine, IEEE Service Center, Feb. 1, 2002, pp. 20-36, vol. 44, No. 1, Piscataway, NJ.

(Continued)

*Primary Examiner* — David Purol

(74) *Attorney, Agent, or Firm* — Zarley Law Firm, P.L.C.

(57) ABSTRACT

A motorized roller shade includes a shade tube, including an outer surface upon which a shade is attached, an inner surface defining an inner cavity and two end portions, a motor/controller unit, disposed within the shade tube inner cavity and mechanically coupled to the shade tube inner surface, including a support shaft configured to attach to a mounting bracket, and a DC motor having an output shaft coupled to the support shaft such that the output shaft and the support shaft do not rotate when the support shaft is attached to the mounting bracket. A wireless receiver is coupled to the motor/controller unit to receive wireless signals and an antenna is arranged on or in at least one of the two end portions.

28 Claims, 8 Drawing Sheets

(51) Int. Cl.

| | |
|---|---|
| ***H01Q 9/27*** | (2006.01) |
| ***H01Q 9/42*** | (2006.01) |
| ***H01Q 1/36*** | (2006.01) |
| ***E06B 9/40*** | (2006.01) |
| *E06B 9/50* | (2006.01) |
| *E06B 9/68* | (2006.01) |

(56) References Cited

U.S. PATENT DOCUMENTS

| | | | | |
|---|---|---|---|---|
| 4,290,070 | A | 9/1981 | Tanaka et al. | |
| 4,584,707 | A | 4/1986 | Goldberg et al. | |
| 4,848,823 | A | 7/1989 | Flohr et al. | |
| 5,313,216 | A | 5/1994 | Wang et al. | |
| 5,453,752 | A * | 9/1995 | Wang et al. | 343/700 MS |
| 5,734,353 | A | 3/1998 | Van Voorhies | |
| 6,104,349 | A | 8/2000 | Cohen | |
| 6,127,977 | A | 10/2000 | Cohen | |
| 6,452,553 | B1 | 9/2002 | Cohen | |
| 6,469,666 | B1 | 10/2002 | Tonn | |
| 6,628,029 | B2 | 9/2003 | Astegno | |
| 6,850,252 | B1 | 2/2005 | Hoffberg | |
| 6,980,092 | B2 | 12/2005 | Turnbull et al. | |
| 7,057,360 | B1 | 6/2006 | Hsu | |
| 7,088,965 | B1 | 8/2006 | Ngan | |
| 7,151,464 | B2 | 12/2006 | Ramus | |
| 7,215,292 | B2 | 5/2007 | McLean | |
| 7,365,685 | B2 | 4/2008 | Takeuchi et al. | |
| 7,453,401 | B2 | 11/2008 | Jow | |
| 7,723,939 | B2 | 5/2010 | Carmen, Jr. | |
| 7,750,774 | B2 | 7/2010 | Fullerton et al. | |
| 7,898,486 | B2 | 3/2011 | Kim et al. | |
| 8,009,433 | B2 | 8/2011 | Ares | |
| 8,044,630 | B2 | 10/2011 | Ramus | |
| 2002/0163473 | A1 | 11/2002 | Koyama et al. | |
| 2003/0160723 | A1 | 8/2003 | Cohen | |
| 2004/0162040 | A1 | 8/2004 | Ramus | |
| 2006/0158045 | A1 * | 7/2006 | Speri | 310/1 |
| 2006/0185799 | A1 | 8/2006 | Kates | |
| 2006/0232233 | A1 | 10/2006 | Adams et al. | |
| 2006/0232234 | A1 | 10/2006 | Newman, Jr. | |
| 2007/0273309 | A1 | 11/2007 | Carmen | |
| 2008/0230192 | A1 * | 9/2008 | Kane | 160/311 |
| 2008/0290823 | A1 | 11/2008 | Grehant | |
| 2009/0005911 | A1 | 1/2009 | Decroix et al. | |
| 2009/0283225 | A1 * | 11/2009 | Luger | 160/310 |
| 2009/0308543 | A1 | 12/2009 | Kates | |
| 2011/0203748 | A1 | 8/2011 | Mullet et al. | |
| 2011/0203754 | A1 | 8/2011 | Mullet et al. | |

OTHER PUBLICATIONS

International Search Report dated Jan. 13, 2013 listing seven references.

* cited by examiner

MOTORIZED ROLLER SHADE OR BLIND HAVING AN ANTENNA AND ANTENNA CABLE CONNECTION

CROSS REFERENCE TO A RELATED APPLICATION

This application is a continuation of U.S. Ser. No. 13/286,542 filed Nov. 1, 2011.

FIELD OF THE INVENTION

The invention relates to a wirelessly operated motorized shade. Specifically, the invention relates to a wirelessly operated motorized shade having an improved antenna arrangement and/or antenna cable connection.

BACKGROUND OF THE INVENTION

A roller shade is a rectangular panel of fabric, or other material, that is attached to a cylindrical, rotating tube. The shade tube is mounted near the header of a window such that the shade rolls up upon itself as the shade tube rotates in one direction, and rolls down to cover a desired portion of the window when the shade tube is rotated in the opposite direction.

Rotation of the roller shade is accomplished with an electric motor that is directly coupled to the shade tube. Recently-developed battery-powered roller shades provide installation flexibility by removing the requirement to connect the motor and control electronics to facility power. The batteries for these roller shades are typically mounted within, above, or adjacent to the shade mounting bracket, headrail or fascia. The motor may be located inside or outside the shade tube, is fixed to the roller shade support and is connected to a simple switch, or, in more sophisticated applications, to a radio frequency (RF) based system that controls the activation of the motor and the rotation of the shade tube. These RF based systems typically need an antenna to transmit and receive RF signals and associated cabling to connect the antenna to a controller. Unfortunately, these RF based systems suffer from many drawbacks, including, for example, poor performance, need for a large area for an antenna, increased costs, increased complexity, and/or the like for the antenna and cabling.

SUMMARY OF THE INVENTION

Aspects of the invention advantageously provide a motorized roller shade that includes a shade tube, including an outer surface upon which a shade is attached, an inner surface defining an inner cavity and two end portions, a motor/controller unit, disposed within the shade tube inner cavity and mechanically coupled to the shade tube inner surface, including a support shaft configured to attach to a mounting bracket, a DC motor having an output shaft coupled to the support shaft such that the output shaft and the support shaft do not rotate when the support shaft is attached to the mounting bracket, a power supply unit, electrically coupled to the motor/controller unit, disposed within the shade tube inner cavity and mechanically coupled to the shade tube inner surface, including a support shaft attachable to a mounting bracket, a wireless receiver coupled to the motor/controller unit to receive wireless signals, and an antenna arranged on or in at least one of the two end portions.

Additional aspects of the invention advantageously provide a motorized roller shade that includes a shade tube including an outer surface upon which a shade is attached, an inner surface defining an inner cavity and two end portions, a motor/controller unit including a support shaft configured to attach to a mounting bracket, a DC motor having an output shaft coupled to the support shaft, a power supply unit, electrically coupled to the motor/controller unit, disposed within the shade tube inner cavity and mechanically coupled to the shade tube inner surface, including a support shaft attachable to a mounting bracket, a wireless receiver coupled to the motor/controller unit to receive wireless signals, and an antenna arranged on or in the motorized roller shade and a coupling that couples the antenna to said wireless receiver.

There has thus been outlined, rather broadly, certain aspects of the invention in order that the detailed description thereof herein may be better understood, and in order that the present contribution to the art may be better appreciated. There are, of course, additional aspects of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the invention. It is important, therefore, that the claims be regarded as including such equivalent constructions insofar as they do not depart from the spirit and scope of the invention.

DETAILED DESCRIPTION

Figure 1:
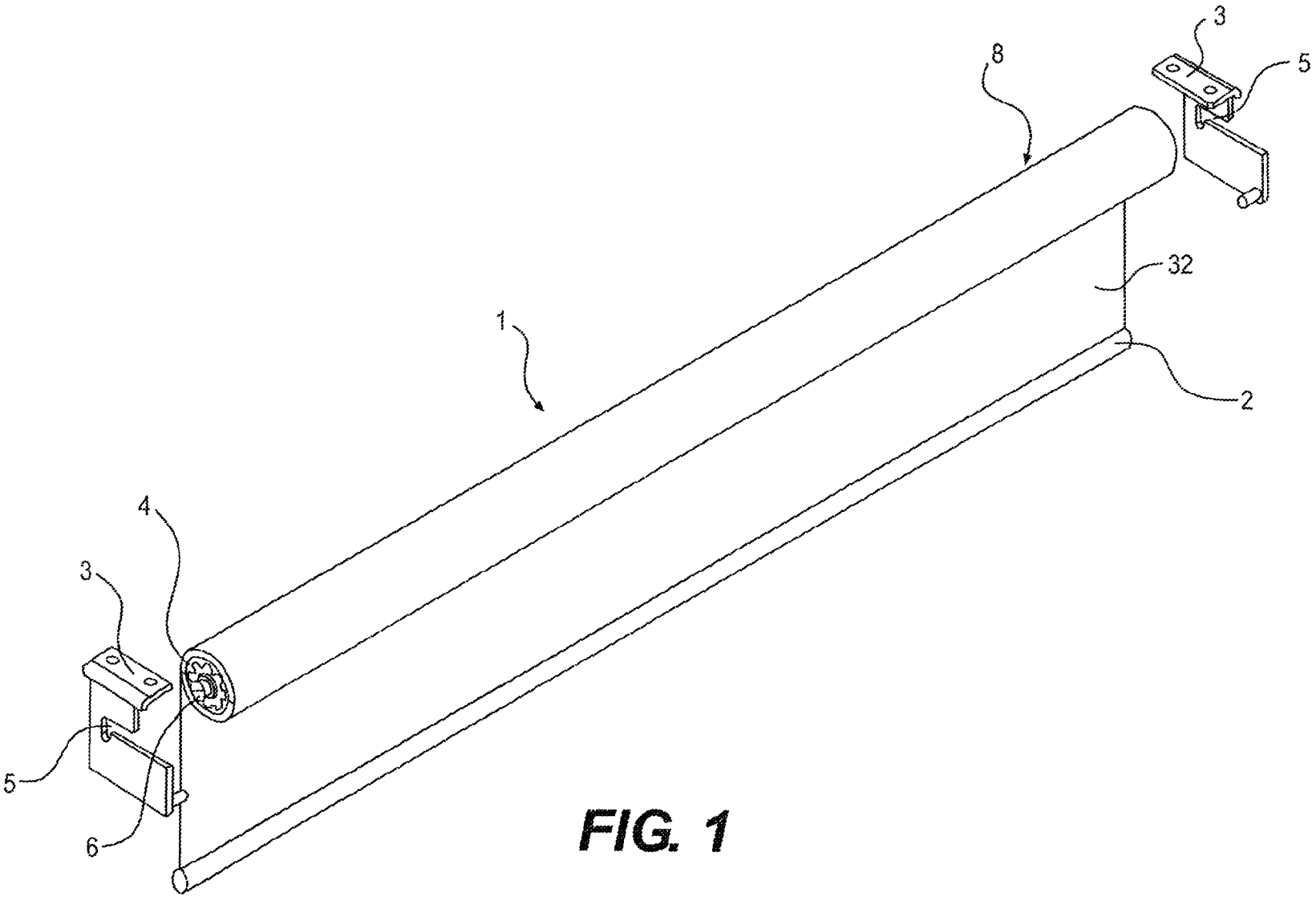
FIG. 1 depicts an isometric view of a motorized roller shade assembly, in accordance with aspects of the invention.

The invention will now be described with reference to the drawing figures, in which like reference numerals refer to like parts throughout. The term "shade" as used herein describes any flexible material, such as a shade, a curtain, a screen, etc., that can be deployed from, and retrieved onto, a storage tube or similar structure.

Aspects of the invention provide a remote controlled motorized roller shade in which the batteries, DC gear motor, control circuitry may be entirely contained within a shade tube that may be supported by bearings. Two support shafts may be attached to respective mounting brackets, and the bearings rotatably couple the shade tube to each support shaft. The output shaft of the DC gear motor may be fixed to one of the support shafts, while the DC gear motor housing is mechanically coupled to the shade tube. Accordingly, operation of the DC gear motor causes the motor housing to rotate about the fixed DC gear motor output shaft, which causes the shade tube to rotate about the fixed DC gear motor output shaft as well. The control circuitry is operated by the user using a radio frequency remote control. Control signals from the remote control are received by the control circuitry through an antenna.

The antenna is arranged on the remote controlled motorized roller shade. In one aspect, the antenna may be arranged on an end of the roller shaft. In a further aspect, the antenna may be a fractal antenna. In another aspect, the antenna may be connected to the control circuitry with a coaxial cable through a connector. The antenna configuration and/or coaxial cable configuration improves performance, reduces the size of the components, reduces costs, reduces complexity, and/or the like.

FIG. 1 depicts an isometric view of a motorized roller shade assembly, in accordance with aspects of the invention. In particular, FIG. 1 shows a motorized roller shade assembly 1 that may be mounted near a top portion of a window, door, or the like. The motorized roller shade assembly 1 may be held using mounting brackets 3. Generally, the motorized roller shade assembly 1 includes a shade 32 and a motorized tube assembly 8. In one aspect, the motorized roller shade assembly 1 may also include a bottom bar 2 attached to the bottom of the shade 32. The bottom bar 2 may provide an end-of-travel stop or other function.

The motorized roller shade assembly 1 may be supported by shafts 6 that may be positioned and retained by openings 5 in the mounting brackets 3. The upper or first end of the shade material is secured to the storage roll 8 by means known in the art. In some aspects, all of the components necessary to power and control the operation of the motorized roller shade assembly 1 may be advantageously located on or within motorized tube assembly 8 (Shown in FIG. 2).

The motorized roller shade assembly 1 also includes an antenna 4 so that control signals may be received in the motorized roller shade assembly 1 and/or transmitted from the motorized roller shade assembly 1. The antenna 4 may be arranged anywhere on or in the motorized roller shade assembly 1. In particular, the antenna 4 may be arranged on an outside surface of the motorized roller shade assembly 1 to improve reception and/or transmission performance. Furthermore, the antenna 4 may be arranged on an outside end surface of the motorized roller shade assembly 1 to further improve reception and/or transmission performance. Additionally, the antenna may be arranged on a Printed Circuit Board (PCB) or wafer 14. Arranging the antenna 4 on a PCB 14 makes manufacturing less complex and less expensive.

Figure 2:
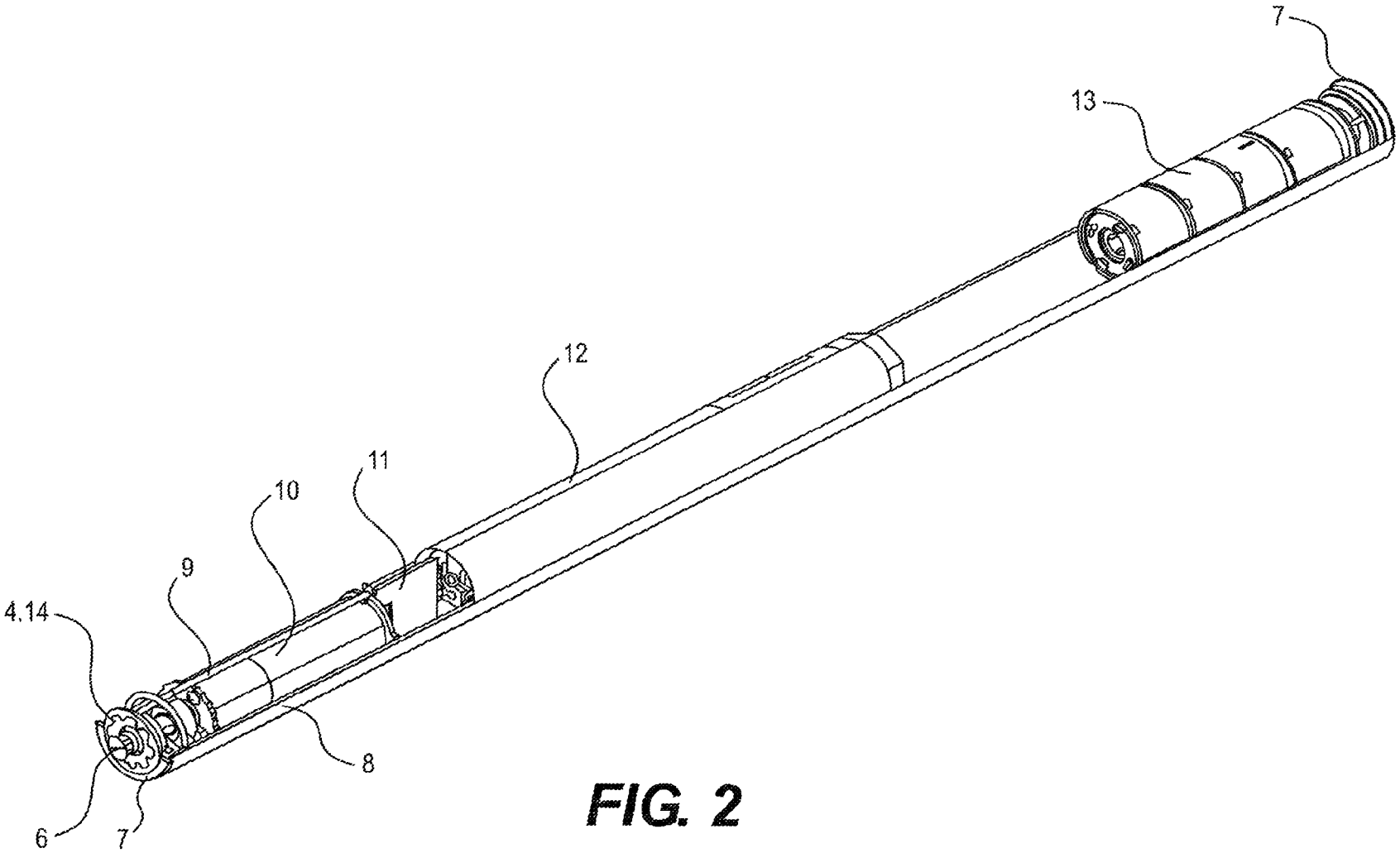
FIG. 2 depicts an isometric internal view of the motorized roller shade assembly depicted in FIG. 1.

FIG. 2 depicts a partial internal isometric view of the motorized roller shade assembly depicted in FIG. 1. As shown in FIG. 2, internal to the storage roll 8 is a motor assembly 10, a motor controller and RF receiver 11, a power supply 12, counterbalance springs 13 and end caps 7 which may hold and position the shafts 6. Note that other arrangements of components may also be used and is within the scope of spirit of the invention.

The end cap 7 closest to the motor may include the PCB 14 or similar mounting structure. The PCB 14 may include a substantially flat surface for the antenna 4. The antenna 4 may be located a distance from the receiver and motor control 11. However, the antenna 4 may be arranged on any surface of the motorized roller shade assembly 1.

Figure 3:
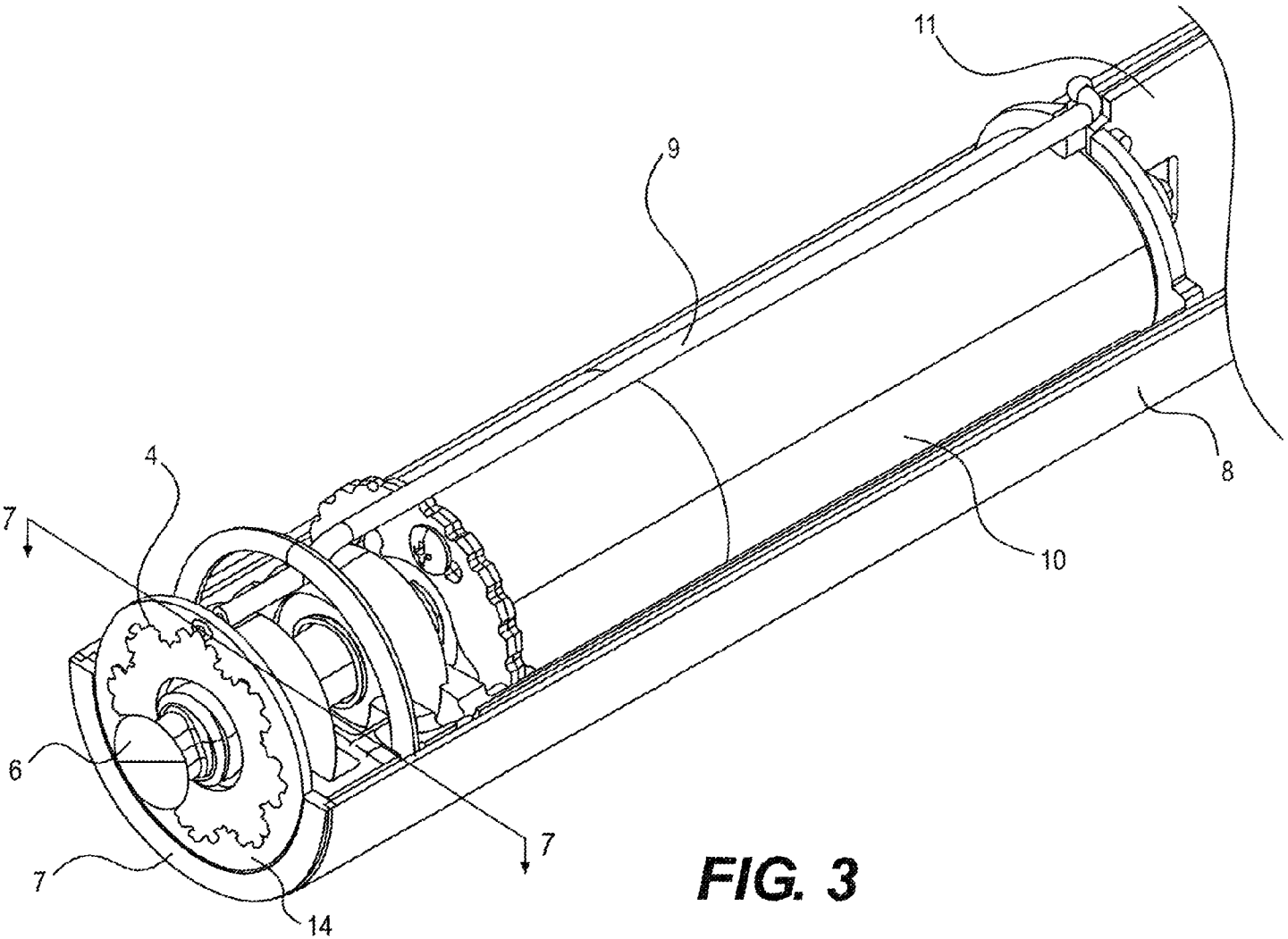
FIG. 3 depicts a partial isometric view of the motorized roller shade assembly depicted in FIG. 2.

FIG. 3 depicts a partial isometric view of the motorized roller shade assembly depicted in FIG. 2. In particular, FIG. 3 shows details of the antenna 4. In particular, the antenna 4 may take the form of a fractal antenna or similar antenna structure that uses a fractal and/or self-similar design to maximize the length, or increase the perimeter that may receive or transmit RF signals within a given total surface area or volume. Similarly, the antenna may be a multilevel and space filling curve that includes a repetition of a motif over two or more scale sizes. The use of a fractal antenna allows for a compact multiband or wideband operation with improved performance.

The RF signals received by the antenna 4 from a user transmitter (not shown) or transmitted from the antenna 4 are carried by wiring to the receiver and motor control 11. The wiring may be a coaxial cable 9.

Figure 4:
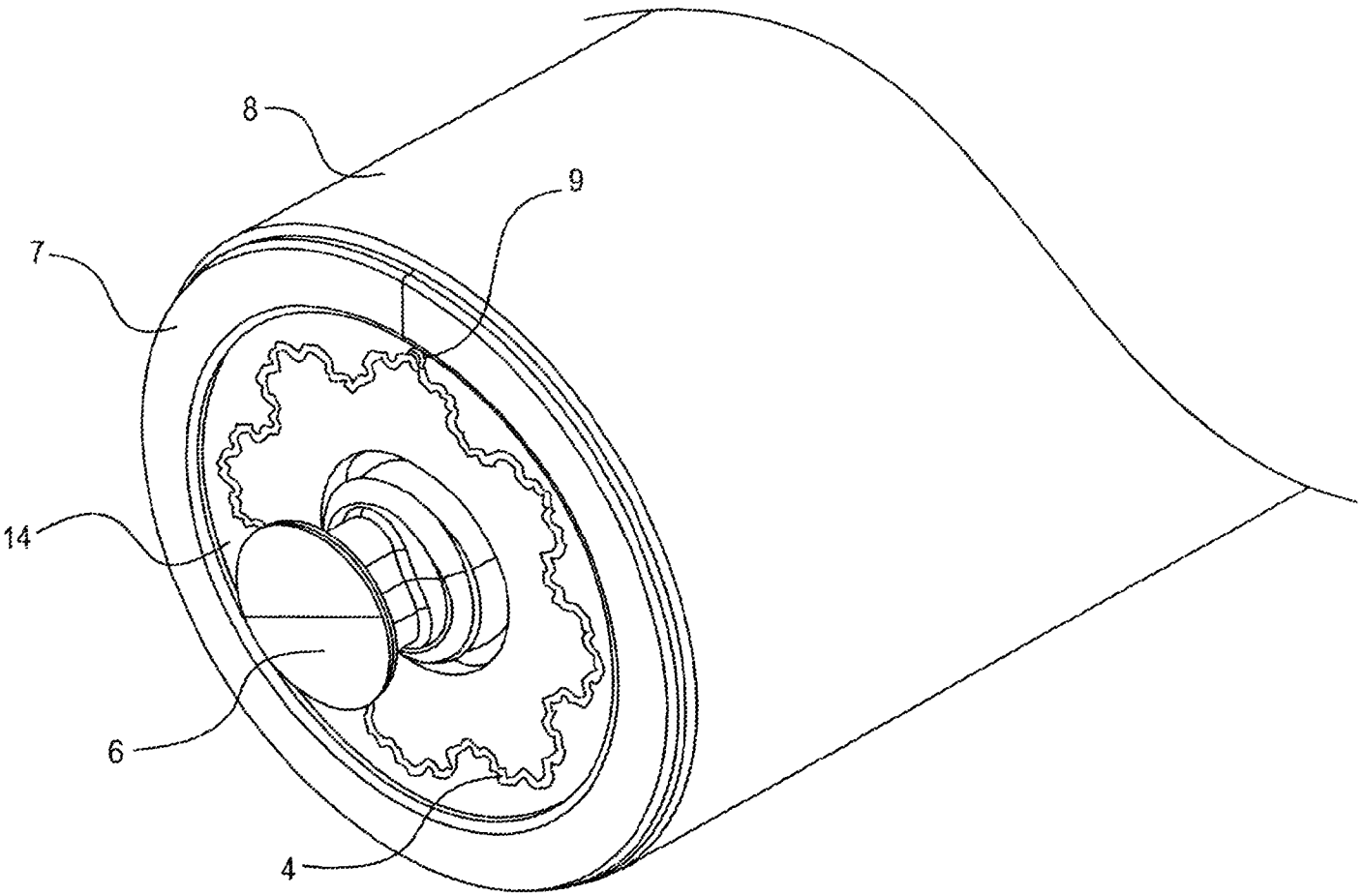
FIG. 4 depicts a partial isometric view of the motorized roller shade assembly depicted in FIG. 1.

FIG. 4 depicts a partial isometric view of the motorized roller shade assembly depicted in FIG. 3. More specifically, FIG. 4 shows details of a particular aspect of the antenna 4. In this particular aspect, the antenna 4 may be implemented as a fourth iteration Van Hoch design fractal antenna. It has been found that the fourth iteration Van Hoch design fractal antenna has superior qualities. However other antennas having a smaller size with the receiving capability of larger antennas are also contemplated including without limitation, other fractal antenna configurations, loop antenna configurations, space filling curve shrunken fractal helix antenna configurations, or the like.

Figure 5:
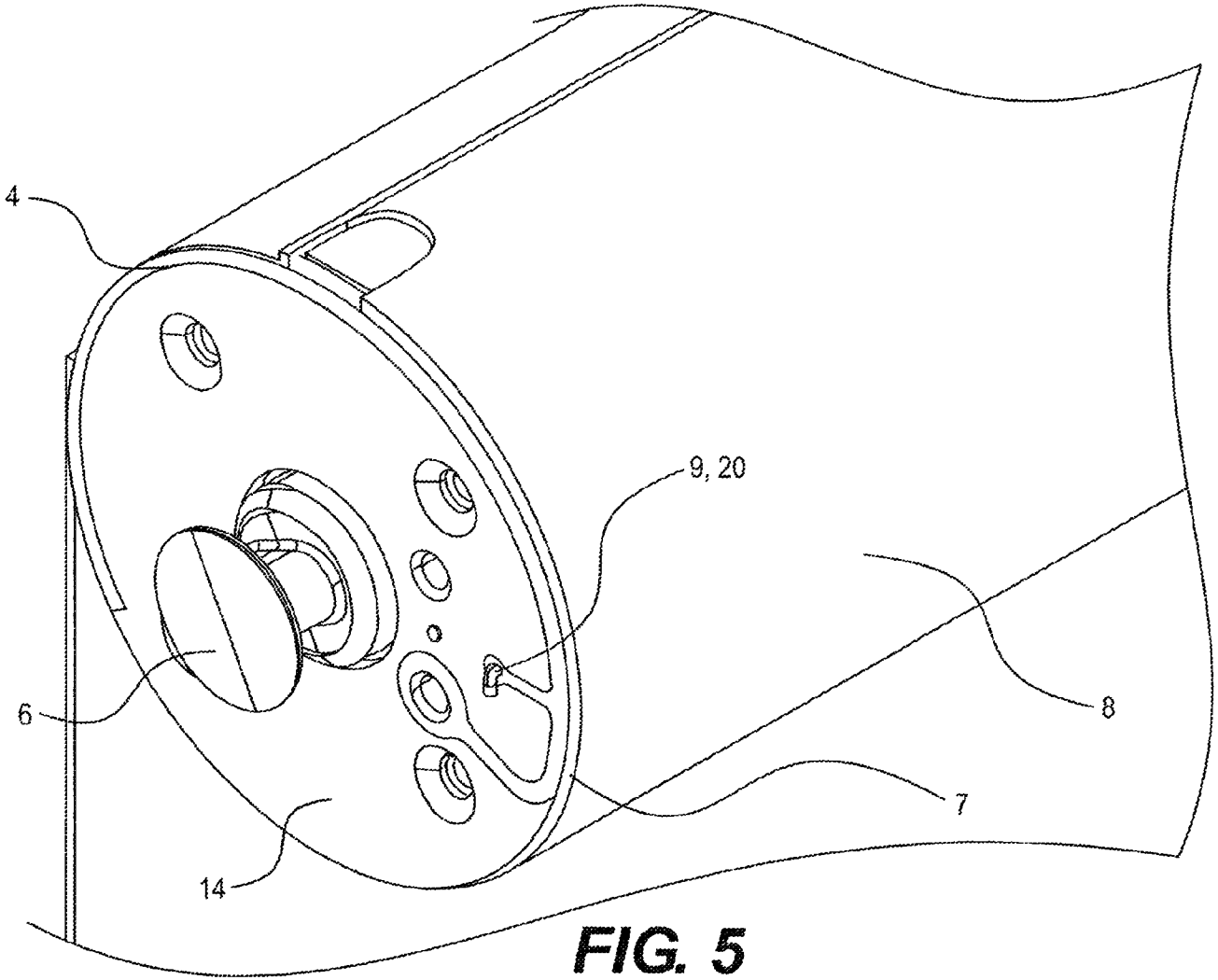
FIG. 5 depicts a partial isometric view of another aspect of the motorized roller shade

FIG. 5 depicts a partial isometric view of another aspect of the motorized roller shade assembly. In particular, FIG. 5 shows an aspect of the antenna 4 arranged in or on PCB 14 that takes the form of a partial circle arranged along an outside edge of the end cap 7. As shown in FIG. 5, the coaxial cable 9 conductor 20 terminates with a wiring connection that extends through the PCB 14 and is electrically connected to the antenna 4.

Figure 6:
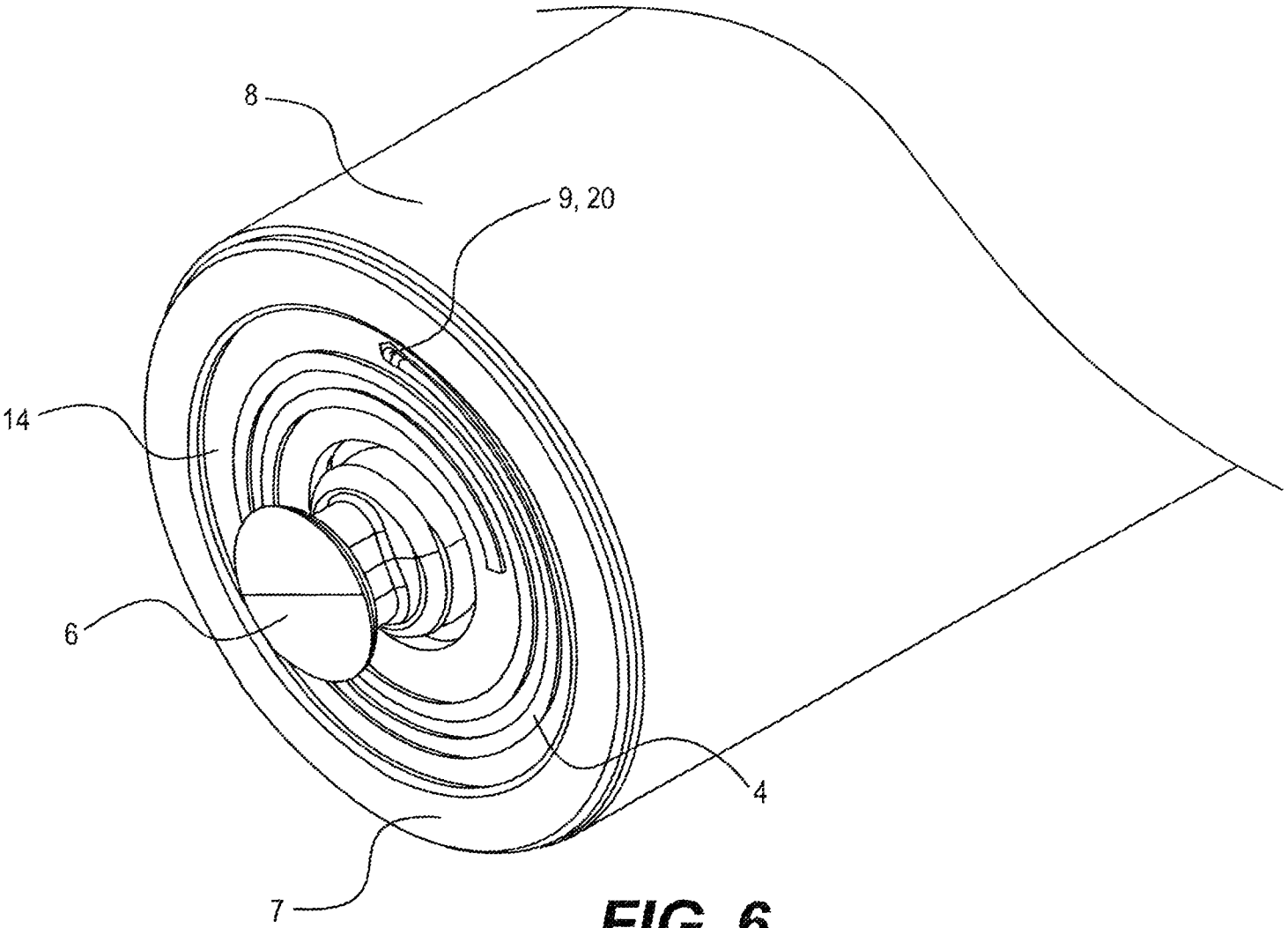
FIG. 6 depicts a partial isometric view of yet another aspect of the motorized roller shade assembly.

FIG. 6 depicts a partial isometric view of yet another aspect of the motorized roller shade assembly. In particular, FIG. 6 shows an aspect of the antenna 4 arranged in or on PCB 14 that takes the form of a spiral. As shown in FIG. 6, the coaxial cable 9 conductor 20 terminates with a wiring connection that extends through the PCB 14 and is electrically connected to the antenna 4.

Figure 7:
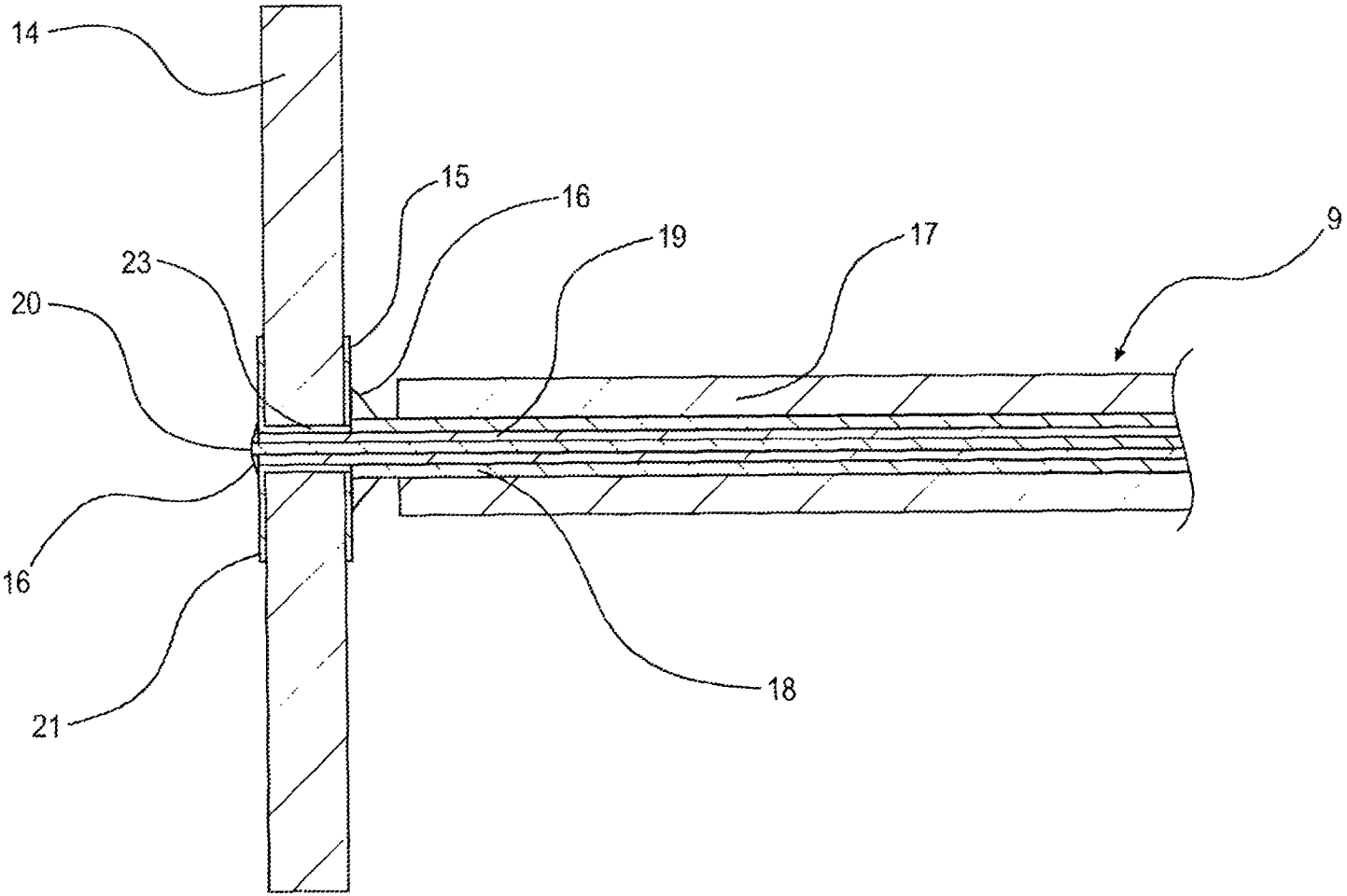
FIG. 7 depicts a cross section view of endcap and antenna connections of the motorized roller shade assembly depicted in FIG. 1.
Figure 8:
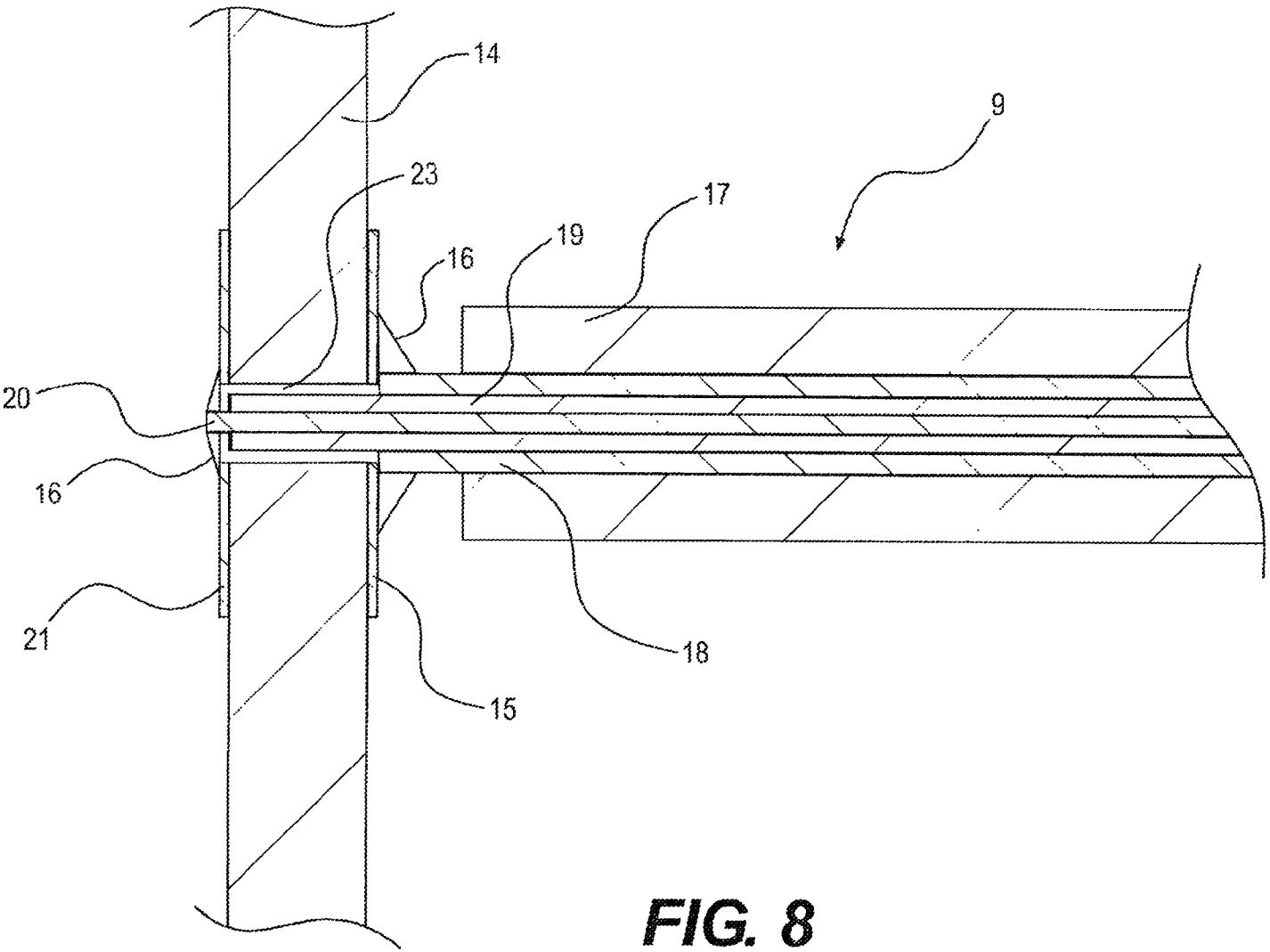
FIG. 8 depicts a partial cross section view of the endcap and antenna connections of the motorized roller shade assembly depicted in FIG. 7.

FIG. 7 depicts a cross section view of endcap and antenna connections of the motorized roller shade assembly depicted in FIG. 3; and FIG. 8 depicts a partial cross section view of the endcap and antenna connections of the motorized roller shade assembly depicted in FIG. 7. In particular, FIGS. 7 and 8 show the connection of the wiring between the antenna 4 and the motorized roller shade assembly 1. The wiring may be implemented as a cable; and more specifically may be implemented as a coaxial cable 9.

Regarding the connection, the coaxial cable 9 may be configured so that an outer insulator 17 is stripped away or removed at an end of the coaxial cable 9 adjacent to the PCB 14. Further, a braid 18 of the coaxial cable 9 may be trimmed to expose a center insulator 19 at the end of the coaxial cable 9 adjacent to the PCB 14. The center insulator 19 then may be trimmed to slightly less than the thickness of the PCB 14.

The coaxial cable 9 with this construction may be inserted into a hole 23 in the PCB 14 that is centered between two pads 15 and 21 (one on the top layer and one on the bottom layer). The two pads 15 and 21 may not be plated through the hole 23 in the PCB 14. The braid 18 may be soldered to pad 15 so as to form a solder connection 16 between the pad 15 and the braid 18. The solder 16 may make an electrical connection between the pad 15 and the braid 18. The solder connection 16 may also serve as a mechanical fastener for fastening the cable 9 to the PCB board 14.

The construction of the solder connection 16 to the pad 15 relieves strain associated with the fragile center conductor 20 and reduces the chance of damage. The PCB hole 23 may be sized to only allow the center insulator 19 inside the PCB board 14.

It should be noted that in this aspect, the size of the common hole is critical to the performance of this construction/method. The braid 18 (outer conductor) should not be allowed to enter into the hole 23. Additionally, the center insulator 19 may be trimmed so as to not protrude beyond the bottom layer 21. However, other configurations are contemplated.

The center conductor 20 may be soldered to the bottom layer 21 and trimmed. Note the insulator 19 can be trimmed to expose the center conductor 20 below the surface near the bottom layer 21. In this alternate fashion, the center conductor 20 may be soldered 16 to the bottom layer 21 and then trimmed very flush to the bottom layer 21.

The connection of the antenna coaxial cable 9 to the PCB 14 can be formed onto or incorporated into a printed circuit board (PCB) 14 placed in the end cap 7 of the storage roll 8. This configuration eliminates the need for a more costly coaxial connector on the cable and costly coaxial socket on the PCB 14. Additionally, the invention reduces the size of the attachment to nearly the diameter of the incident coaxial cable. The invention relieves strain associated with the cable directly at the PCB 14, allowing flexing immediately above the PCB 14 surface. With a connector of the invention, the strain relief occurs at the back of the connector, thus not allowing the cable to flex at the PCB itself.

The motorized roller shade assembly 1 may include other components such as an electrical power connector that includes a terminal that couples to a power supply unit, and power cables that may connect to the circuit board(s) located within the circuit board housing.

Two circuit boards may be mounted within the circuit board housing in an orthogonal relationship. Circuit boards generally include all of the supporting circuitry and electronic components necessary to sense and control the operation of the motor, manage and/or condition the power provided by the power supply unit, etc., including, for example, a controller or microcontroller, memory, a wireless receiver, etc. In one embodiment, the microcontroller is a Microchip 8-bit microcontroller, such as the PIC18F25K20, while the wireless receiver is a Micrel QwikRadio® receiver, such as the MICRF219. The microcontroller may be coupled to the wireless receiver using a local processor bus, a serial bus, a serial peripheral interface, etc. In another embodiment, the wireless receiver and microcontroller may be integrated into a single chip, such as, for example, the Zensys ZW0201 Z-Wave Single Chip, etc.

In another embodiment, a wireless transmitter is also provided, and information relating to the status, performance, etc., of the motorized roller shade may be transmitted periodically to a wireless diagnostic device, or, preferably, in response to a specific query from the wireless diagnostic device. In one embodiment, the wireless transmitter is a Micrel QwikRadio® transmitter, such as the MICRF102. A wireless transceiver, in which the wireless transmitter and receiver are combined into a single component, may also be included, and in one embodiment, the wireless transceiver is a Micrel RadioWire® transceiver, such as the MICRF506. In another embodiment, the wireless transceiver and microcontroller may be integrated into a single module, such as, for example, the Zensys ZM3102 Z-Wave Module, etc. The functionality of the microcontroller, as it relates to the operation of the motorized roller shade 320, is discussed in more detail below.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A motorized roller shade, comprising:
a shade tube extending a length between a first end and a second end;
the shade tube having an outer surface and an inner surface defining an inner cavity;
a shade connected to the shade tube;
a motor/controller unit positioned within the inner cavity;
an antenna operatively connected to the motor/controller unit;
a first support shaft positioned approximate the first end;
a second support shaft positioned approximate the second end;
wherein the antenna is positioned approximate the first end;
wherein the first support shaft extends through the antenna.

2. The motorized roller shade of claim 1 wherein the antenna is a fractal antenna.

3. The motorized roller shade of claim 1 wherein the first support shaft and the second support shaft are connected to brackets.

4. The motorized roller shade of claim 1 wherein the antenna is configured on or in a printed circuit board.

5. The motorized roller shade of claim 1 wherein the antenna is configured on or in a generally circular disk.

6. The motorized roller shade of claim 1 wherein the antenna is held within a first end cap.

7. The motorized roller shade of claim 1 wherein the antenna faces outwardly from the first end.

8. The motorized roller shade of claim 1 wherein the antenna is positioned in generally perpendicular alignment to the length of the shade tube.

9. The motorized roller shade of claim 1 wherein the antenna is positioned in generally parallel alignment to the open first end of the shade tube.

10. The motorized roller shade of claim 1 wherein the antenna is positioned between the first end of the shade tube and a first bracket connected to the first support shaft.

11. A motorized roller shade, comprising:
a shade tube extending a length between a first end and a second end;
the shade tube having an outer surface and an inner surface defining an inner cavity;
a shade connected to the shade tube;
a motor/controller unit positioned within the inner cavity;
at least one counterbalance spring positioned within the inner cavity;
a first support shaft connected approximate the first end;
the first support shaft connected to a first bracket;

a fractal antenna positioned approximate the first end;

wherein the first support shaft extends through the fractal antenna.

12. The motorized roller shade of claim 11 wherein the antenna is Configured on or in a printed circuit board.

13. The motorized roller shade of claim 11 wherein the antenna is positioned between the first end of the shade tube and the first bracket.

14. The motorized roller shade of claim 11 wherein the first support shaft extends through the antenna.

15. The motorized roller shade of claim 11 wherein the antenna is held approximate the first end by a first end cap.

16. A motorized roller shade, comprising:

an elongated shade tube extending a length between a first end and a second end;

the shade tube having an outer surface and an inner surface defining an inner cavity;

a shade connected to the shade tube;

a first end cap connected to the first end;

a second end cap connected to the second end;

a first support shaft extending outwardly from the first end cap;

a second support shaft extending outwardly from the second end cap;

the first support shaft connected to a first bracket;

the second support shaft connected to a second bracket;

an antenna held by the first end cap;

wherein the antenna is positioned approximate the first end;

wherein the first support shaft extends through the antenna.

17. The motorized roller shade of claim 16 wherein the antenna is a fractal antenna.

18. The motorized roller shade of claim 16 wherein the antenna is formed on or in a printed circuit board.

19. The motorized roller shade of claim 16 wherein the antenna faces outwardly from the first end.

20. The motorized roller shade of claim 16 wherein the antenna is positioned within the open first end of the shade tube.

21. The motorized roller shade of claim 16 wherein the antenna is positioned between the open first end of the shade tube and the first bracket.

22. The motorized roller shade of claim 16 further comprising a motor and motor/controller positioned within the inner cavity.

23. The motorized roller shade of claim 16 further comprising at least one counterbalance spring positioned within the inner cavity.

24. The motorized roller shade of claim 16 further comprising a power supply positioned within the inner cavity.

25. The motorized roller shade of claim 16 wherein the first support shaft extends through the antenna.

26. The motorized roller shade of claim 16 wherein the antenna is held approximate the first end by the first end cap.

27. A motorized roller shade, comprising:

a shade tube extending a length between a first end and a second end;

the shade tube having an outer surface and an inner surface defining an inner cavity;

a shade connected to the shade tube; and a fractal antenna positioned in the open first end of the shade tube;

wherein a first support shaft extends through the antenna.

28. A motorized roller shade, comprising:

a shade tube extending a length between a first end and a second end;

the shade tube having an outer surface and an inner surface defining an inner cavity;

a shade connected to the shade tube; and a fractal antenna positioned between the open first end of the shade tube and a first bracket connected to the first end;

wherein a first support shaft extends through the fractal antenna.

* * * * *